United States Patent [19]

Koitabashi et al.

[11] 4,444,877

[45] Apr. 24, 1984

[54] LIGHT-SENSITIVE SILVER HALIDE EMULSION

[75] Inventors: Takeo Koitabashi; Yoshihiro Haga; Syoji Matsuzaka, all of Hino, Japan

[73] Assignee: Konishiroku Photo Ind. Co., Ltd., Tokyo, Japan

[21] Appl. No.: 347,258

[22] Filed: Feb. 9, 1982

[30] Foreign Application Priority Data

Feb. 18, 1981 [JP] Japan ..... 56-23396

[51] Int. Cl.[3] ..... G03C 1/02

[52] U.S. Cl. ..... 430/567; 430/568; 430/569

[58] Field of Search ..... 430/567, 568, 569

[56] References Cited

U.S. PATENT DOCUMENTS

| | | | |
|---|---|---|---|
| 3,206,313 | 9/1965 | Porter et al. | 430/564 |
| 3,501,305 | 3/1970 | Illingsworth | 430/567 |
| 3,505,068 | 4/1970 | Beckett et al. | 430/138 |
| 4,142,900 | 3/1979 | Maskasky | 430/567 |

*Primary Examiner*—J. Travis Brown

*Attorney, Agent, or Firm*—Frishauf, Holtz, Goodman & Woodward

[57] ABSTRACT

A light-sensitive silver halide emulsion is disclosed, which comprises cores composed of silver halide grains and shells covering the cores. The cores consist essentially of silver halide containing silver iodide, and the shells consist essentially of silver bromide, silver chloride or silver chlorobromide excluding silver iodide. The shells have a thickness of from 0.01 to 0.1$\mu$. This light-sensitive silver halide emulsion has high sensitivity and superior covering power.

7 Claims, No Drawings

LIGHT-SENSITIVE SILVER HALIDE EMULSION

The present invention relates to a light-sensitive silver halide emulsion, and particularly to an improvement of the sensitivity, the covering power and the like of the emulsion.

The requirements for a photographic silver halide emulsion are quite severe. As its photographic properties, high sensitivity, good graininess, sharpness, abundant latitude, sufficiently high optical density and low fog density are required. In addition thereto, as its processability, rapid and efficient developability, fixability and washability and high resistibility against the treating agents are required. Further, it is necessary that such photographic properties and processability must be stable without change even when being on the market for a long period of time. Besides, from the standpoint of its productivity, the quality of the emulsion must be reproducible and dependable, and the production cost must be low.

In view of such requirements, two- or three-component emulsions comprising silver chloride, silver bromide or silver iodide, have been studied from the aspect of the silver halide composition. In regard to a condition of solutions for the preparation of such emulsions, an ammonium system, an acidic system and a neutral system have been studied taking the pH and pAg into account. As a method for mixing such solutions, single jet or double jet, or a combination of both, has been used once or many times to investigate an influence of the granularity distribution in a mono-dispersion or multi-dispersion of the emulsion grains. Further, the effects of the crystal system, the crystal face and the crystal habit, more particularly, the solid solution or mixed crystal state of silver chloride, bromide and iodide in the silver halide grains, and their uniform or local distribution, have been questioned experimentally or theoretically from the standpoints of the solid physical theory, the dislocation theory, etc.

Further, there have been studies on methods in which the crystal growth mechanisms are distinctly separated. Namely, one of them is a conversion method in which a part or the whole of the preceding silver halide precipitates having a great solubility product is replaced by or converted into a silver halide having a small solubility product. Another method is a lamination (i.e. core-shell) method in which the preceding silver halide is used as a crystal nucleus, and subsequent precipitates are gradually laminated thereon, where the composition of the precipitates or the environment for the laminating process is intentionally controlled.

As mentioned above, detailed studies have been made in view of the severe requirements for the photographic properties, the processability, the durability and the productivity of photographic silver halide emultions. However, silver halide emulsions prepared under such careful considerations, tend to exhibit, despite their phisical resemblance, a surprising difference in their photographic properties, processability or durability owing to their own natures or doping, chemical sensitization, dye sensitization or synergistic effects of various additives. To the contrary, in spite of their physical differences, they often exhibit no significant difference in their properties. Accordingly, various properties of the emulsions are too intricate to be judged from a simple prediction, and experimental establishments are, therefore, necessary to know them.

On the other hand, the respective subdivided performance factors governing the photographic properties, processability and durability are mostly in a relation exclusive or repellent to each other, accordingly product designs of the emulsions have practically been made by unifying the discriminated performance factors in each group.

However, the absolute superiorities of the silver halide over light-sensitive materials other than the former reside in its sensitivity and granular sharpness. There is therefore desired a new emulsion in which the above-mentioned superiorities are utilized, a treatment speed is built up to a level equal to the other light-sensitive materials, and in view of the circumstances of silver resources in recent years, such high covering power as gives high optical density in a small silver amount is maintained.

Accordingly, it is an object of the present invention to provide a light-sensitive silver halide emulsion having high sensitivity, good granularity and sharpness as well as efficient processability and high covering power. Other objects of the present invention will become apparent from the following description in the specification. The covering power of the emulsion herein will be expressed by a ratio of the optical density formed by developed silver to the amount of the developed silver per unit area.

The above mentioned objects of the present invention are achieved by a light-sensitive silver halide emulsion comprising silver halide grains composed of a core consisting essentially of silver halide containing silver iodide and a shell covering said core and consisting essentially of silver bromide, silver chloride or silver chlorobromide, said shell having a thickness of from 0.01 to 0.1$\mu$.

According to a preferred embodiment of the light-sensitive silver halide emulsion of the present invention, the cores may be composed essentially of a silver halide containing from 0.5 to 10 molar % of silver iodide.

According to another preferred embodiment of the present invention, the shells may consist essentially of silver bromide.

According to still another preferred embodiment thereof, the cores may be composed of mono-dispersion type silver halide grains.

According to a further preferred embodiment, each of the shells may have a thickness of from 0.01 to 0.06$\mu$.

According to a still further preferred embodiment, the cores may be composed of mono-dispersion type silver halide grains containing from 0.5 to 10 molar % of silver iodide.

According to a still further preferred embodiment, the shells may consist essentially of silver bromide and each of the shells may have a thickness of from 0.01 to 0.06$\mu$.

As a method for highly sensitizing silver halide grains themselves, it is known to add silver bromide to silver chloride, or silver iodide to silver bromide or silver chlorobromide, to such an extent that a solid solution or a certain degree of mixed crystals is formed. For instance, "Photographic Journal, Vol. 79 (1939) page 463 et seq." discloses that when silver iodide is incorporated in silver bromide, the sensitivity increases corresponding to the increase in the amount of the silver iodide until the latter reaches a certain content. As another method, silver halide grains are formed in a large size to increase the light receiving capacity of each grain and thereby to enhance its developability.

The silver halide grains mixed with silver iodide increase in a photochemical sensitivity, as the light quantum yield of the grains themselves is improved. However, it has been found by the studies conducted by the present inventors that if there is present as low as 1.5 molar % of silver iodide on said grains, effectiveness of the chemical sensitization, which is an important factor for an increase in the sensitivity, is thereby suppressed, and the efficiency of the development or fixation is thereby suppressed, and thus, after all, the objective for high sensitization can not adequately be accomplished, and that the processability will also be thereby impaired. On the other hand, if it is attempted to increase the sensitization by forming coarse grains, the image quality or photographic properties such as granularity or sharpness, will thereby be impaired to a great extent, and the covering power tends to be reduced.

The feature of the present invention resides in that a core is formed from silver halide grains containing silver iodide and a shell of a predetermined thickness as specified above is formed from a silver halide containing no silver iodide to shield the core, whereby the highly sensitizing nature of the silver halide grains containing silver iodide is effectively utilized and at the same time, the above-mentioned disadvantageous nature of said grains is shielded. More specifically, cores are formed from a silver halide containing silver iodide, and in order to take out only the desirable function of the cores and at the same time to shut out the undesirable behavior of the cores, the cores are coated with shells having a thickness which is strictly regulated within the necessary range. The method of coating with shells having a minimum absolute thickness required to effectively draw out the desirable nature of the cores, is also applicable for other purposes, for instance, for the purposes of improving the durability or improving the sensitizing dye adsorption, by changing the core and shell materials.

The silver iodide content in the silver halide grains constituting the cores, is from 0.1 to 20 molar %, i.e. the range within which a solid solution or mixed crystals are formed, and it is preferably from 0.5 to 10 molar %. The distribution of the silver iodide in the cores may be maldistribution or uniform distribution, but it is preferably the uniform distribution.

The silver halide emulsion, which includes silver halide grains having a shell of a predetermined thickness according to the present invention, can be prepared by coating with shells cores of silver halide grains contained in a mono-dispersion emulsion.

Cores of mono-dispersion type silver halide grains may be prepared by the double jet method while maintaining pAg at a constant level, whereby grains of a desired size are obtainable. Further, a high degree mono-dispersion type silver halide emulsion may be prepared by the method described in Japanese Laid-Open Patent Application No. 48521/1979. As a preferred embodiment of that method, there may be mentioned a production method in which an aqueous potassium iodide-gelatin solution and an aqueous ammonia-type silver nitrate solution were added to an aqueous gelatin solution containing silver halide seed grains by varying the rate of addition as a function of time. In this case, by properly selecting the rate of addition as a time function, a pH, a pAg, a temperature, etc., it is possible to obtain a high-grade mono-dispersion type silver halide emulsion.

The grain size distribution of the mono-dispersion type emulsion assumes normal distribution in most cases and accordingly the standard deviation can easily be obtained. If the breadth (%) of the distribution is defined by the following formula:

$$\frac{\text{Standard deviation}}{\text{Average grain size}} \times 100 = \text{Distribution breadth (\%)},$$

the distribution breadth permissible for significantly regulating the absolute thickness of the coating must be at most 20% as the level of the mono-dispersion, and preferably at most 10%.

Next, the thickness of the shell for coating the core must be a thickness which does not shield the desirable nature of the core and at the same time, the thickness must be sufficient to shield the undesirable nature of the core. Namely, the thickness is restricted to a narrow range defined by such upper and lower limits. Such a shell can be formed by depositing a soluble halogen compound solution and a soluble silver salt compound solution on the mono-dispersion type cores by the double jet method.

For instance, when experiments were conducted by use of mono-dispersion type silver halide grains having an average grain size of about 1μ and containing 2 molar % of silver iodide as the cores and silver bromide as the shells and by varying the thickness of the shells, it was found that in a case where the thickness of the shells was 0.5μ, the covering power of the mono-dispersion type silver halide grains according to this method was low. This was then treated with a treatment solution having physical developing power and containing a solvent capable of dissolving a silver halide, and then observed by a scanning type electron microscope, whereby it was found that there were no filaments of the developed silver. This indicates that the optical density was thereby reduced and accordingly the covering power was deteriorated. Then, taking the shapes of the filaments of the developed silver into account, an experiment was further conducted in which the thickness of the shells was gradually reduced while varying the average grain size of the cores. It was resultingly found that irrespective of the average grain size of the cores, when the thickness of the shells was adjusted to be at most 0.1μ as the absolute thickness, a number of good developed silver filaments were formed, whereby adequate optical density was obtained and the high sensitizing nature of the cores was not impaired. Namely, when it was attempted to use the method for producing a silver halide emulsion having production stability by depositing shells on cores as crystal nuclei as disclosed in e.g. Japanese Patent Publications No. 18103/1971 and No. 21657/1974, it was naturally impossible to accomplish the object of the present invention.

On the other hand, if the thickness of the shells is too thin, the bare surface of the cores containing silver iodide tends to be partially exposed, whereby performances such as the effect of coating the surface with the shells, i.e. the chemical sensitizing effect, the speedy developability and the fixability will be lost. The lower limit of the thickness is 0.01μ.

When confirmed with high degree mono-dispersion type cores having a distribution breadth of at most 10%, a preferred thickness of the shells was found to be from 0.01 to 0.06μ, and the most preferred thickness was 0.03μ.

The above mentioned desired results such that the developed silver filaments are adequately formed to improve the optical density, that the high sensitizing nature of the cores are utilized to produce sensitizing effectiveness and that the speedy developability and fixability are obtainable, are all dependent on the shells having the thickness regulated as mentioned above depending upon the high degree mono-dispersion type cores and the synergistic effects among the silver halide compositions of the cores and shells. Accordingly, once the condition for the thickness of the shells is satisfied, the silver halide constituting the shells may be selected from silver bromide, silver chloride and silver chlorobromide, excluding silver iodide. Among them, silver bromide is preferred for its affinity to the cores, its property stability or its durability.

The light-sensitive silver halide emulsion of the present invention may be doped with various metal salts or metal complex salts during the formation of silver halide precipitates of the cores and shells, during the growth of the grains or after the grain growth has been completed. For instance, a metal salt or a complex salt of gold, platinum, palladium, iridium, rhodium, bismuth, cadmium or copper, or a combination thereof may be used for the doping.

Further, the halogen compounds excessively formed during the preparation of the emulsion of the present invention or the salts or compounds of nitrates or ammonia which have been produced as by-products or which have become useless, may be removed. As the method for such removal, there may be used an appropriate method which is commonly used for usual emulsions, such as Nudel water washing method, a dialysis method or a coagulation precipitation method.

Further, various chemical sensitization methods which are commonly applied to usual emulsions, may be applied to the emulsions of the present invention. Namely, chemical sensitization agents, for instance, active gelatin; noble metal sensitizing agents such as a water-soluble gold salt, a water-soluble platinum salt, a water-soluble palladium salt, a water-soluble rhodium salt and a water-soluble iridium salt; sulfur sensitizing agents; selenium sensitizing agent; or reduction sensitizing agents such as polyamines and stannous chloride, may be used alone or in combination for the chemical sensitization. Further, the silver halide can optically be sensitized to have a desired wave length. There is no particular restriction to the method for optical sensitization of the emulsion of the present invention. For instance, optical sensitization agents, e.g. cyanine dyes or merocyanine dyes such as a zeromethine dye, a monomethine dye, a dimethine dye, and trimethine dye, may be used alone or in combination (e.g. for super dye sensitization) for the optical sensitization. Techniques for such optical sensitization are also disclosed, for instance, in U.S. Pat. Nos. 2,688,545, 2,912,329, 3,397,060, 3,615,639, 3,397,060, 3,615,635, and 3,628,964, British Pat. Nos. 1,195,302, 1,242,588 and 1,293,862, German Patent (OLS) Nos. 20 30 326 and 21 21 780 and Japanese Patent Publication Nos. 4936/1968 and 14030/1969. The selection may be optionally made depending upon the particular application or purpose of the light-sensitive material, such as the desired wave length for sensitization, or the desired sensitivity.

According to the present invention, for the formation of silver halide grains, a silver halide emulsion composed of mono-dispersion type silver halide grains is used for the core grains, and the core grains are coated with shells to obtain a mono-dispersion type silver halide emulsion in which the thickness of the shells is almost uniform. Such a mono-dispersion type silver halide emulsion may be used as it is with its grain distribution as formed, or two or more mono-dispersion type emulsions having different grain sizes may be blended at an optional stage after the formation of the grains to obtain a predetermined gradient before use.

It is desired that the emulsion of the present invention contains the silver halide grains of the invention in a proportion, based on the total silver halide grains contained in the emulsion, at least equal to the emulsion obtained by coating with shells mono-dispersion type cores having a distribution breadth of less than 20%. However, the emulsion of the present invention may contain silver halide grains other than those of the present invention to such an extent that the effectiveness of the present invention is not thereby impaired.

In the emulsion of the present invention, it is preferred that at least 65% by weight of the silver halide grains contained in the emulsion is composed of the silver halide grains of the present invention and it is desirable that almost all of the grains are composed of the silver halide grains of the present invention.

The emulsion of the present invention may contain various additives which are commonly used, as the case requires.

For instance, stabilizers or antifoggants such as azaindenes, triazoles, tetrazoles, imidazolium salts, tetrazolium salts and polyhydroxy compounds; film hardening agents such as an aldehyde type, an aziridine type, inooxazole type, a vinyl aulfone type, an acryloyl type, an albodiimide type, a maleimide type, a methane sulfonic ester type, and a triazine type; development accelerators such as benzyl alcohol, and a polyethylene compound; image stabilizers such as a coumarone type, a coumarin type, a bisphenyl type, a phosphorous ester type; and lubricants such as wax, glycerides of higher fatty acids, and higher alcohol esters of higher fatty acids. Further, various types of surfactants such as an anion type, cationic type and an ampholytic type may be used as a coating assistant, an agent to improve the penetration property of treatment solutions, a defoaming agent and an agent to regulate various physical properties of the light-sensitive materials. As the antistatic agents, diacetyl cellulose, a styrene-perfluoroalkyl ridium maleate copolymer and an alkali salt of a reaction product of a styrene-anhydrous maleic acid copolymer with p-aminobenzene sulfonic acid, are useful. As the matt agents, there may be mentioned methyl polymethacrylate, polystyrene and an alkaline soluble polymer. Also colloidal silicon oxides may be used. Further, as the latex to be incorporated to improve the physical properties of the film, there may be mentioned, copolymers of an acrylic ester or vinyl ester with other monomers having an ethylene group. As the gelatin plasticizers, there may be mentioned glycerine and glycol type compounds. As the thickners, there may be mentioned a styrene-sodium maleate copolymer and an alkylvinyl ether-maleic acid copolymer.

As a support for the light-sensitive material prepared with use of the emulsion of the present invention which has been prepared in a manner as mentioned above, there may be used, for instance, baryta paper, polyethylene coated paper, polypropyrene synthetic paper, glass paper, cellulose acetate, cellulose nitrate, polyvinyl acetal, polypropylene, a polyester film such as polyethylene terephthalate, or polystyrene. The support is optionally selected depending upon the particular purpose of the silver halide light-sensitive photographic material.

These support may be subjected to an undercoating treatment as the case requires.

The emulsion of the present invention may be applied to various types of light-sensitive materials such as those for general purpose black and white photography, x-ray photography, colour photography, infrared photography, micro photography, silver dye bleach process, a reversal process, and a diffusion transfer process.

In order to obtain a wide range of latitude by means of the emulsion of the present invention, at least two kinds of mono-dispersion type emulsions, which are different in avarage grain sizes or in sensitivities, may be mixed, or coated so as to form a plurality of laminated layers. Thus, a light-sensitive material having adequate latitude as well as light covering power or high optical density with a small amount of silver, i.e. the properties derived from the emulsion of the present invention, is obtainable. Further, when the emulsion of the present invention is applied to a light-sensitive material for colour photography, techniques and materials which are commonly employed in the preparation of light-sensitive colour photographic materials, may be used, for instance, by incorporating cyan, magenta and yellow couplers in a suitable combination into the emulsion of the present invention which is adjusted for red sensitivity, green sensitivity and blue sensitivity.

After exposure of the light-sensitive material prepared by use of the emulsion of the present invention, it may be developed by a known method commonly used for developing treatment.

The black and white developer is an alkaline solution containing developing agents such as hydroxy benzenes, aminophenols, or aminobenzenes, and it may further contain alkali metal salts such as a sulfite, a carbonate, a bisulfite, a bromide and an iodide. When the light-sensitive material is for colour photography, it may be developed by a colour developing process which is commonly used. In a reversal process, it is firstly developed by a developer for a black and white negative and then subjected to white colour exposure, or subjected to treatment in a bath containing a fogging agent, and further developed for colour development in an alkaline developing solution containing colour developing agents. There is no particular restriction to the method for treatment, and any method may be applied. As a typical example, however, there may be mentioned, a system in which bleach-fix treatment is conducted after the colour development and further washing and stabilizing treatments are carried out as the case requires, or a system in which the bleaching and the fixing are separately carried out after the colour development, and further washing and stabilizing treatments are carried out as the case requires. Further, it is known to treat a light-sensitive material having a low silver halide content with use of an amplifier agent such as a hydrogen peroxide-cobalt complex salt, and such a treatment may also be used. These treatments may be carried out at an elevated temperature for speedy treatment, or may be carried out at room temperature, or in a special case, at a temperature lower than room temperature. In the case of the speedy treatment at an elevated temperature, preliminary film hardening treatment may also be carried out. Further, according to the type of the treatment agents used, it may be required to use any auxiliary bath such as a neutralizing bath, and such an auxiliary bath may optionally used as the case requires.

Now, the present invention will be described in detail with reference to Examples. However, it should be understood that the present invention is not limited to these specific Examples.

EXAMPLE 1

The following four kinds of mono-dispersion type cubic system emulsions A, B, C and D composed of silver iodobromide containing 1.5 molar % of silver iodide and having an average grain size of 1.2$\mu$, and a mono-dispersion type cubic system emulsion E composed of pure silver bromide having an average grain size of 1.2$\mu$, were respectively subjected to gold sensitization and sulfur sensitization; after completion of aging, 4-hydroxy-6-methyl-1,3,3a,7-tetrazaindene was added; then, to these emulsions, common photographic additives such as an extender, an thickner and a film hardener, were added; and the emulsions thus prepared were respectively coated on an undercoated polyethylene terephthalate film base to bring the Ag amount to be 50 mg/100 cm$^2$ by a usual method, and then dried, whereupon Samples No. 1 to No. 5 were prepared.

Emulsion A was composed of silver iodobromide with silver bromide shells (having a thickness of 0.2$\mu$).

Emulsion B was composed of silver iodobromide with silver bromide shells (having a thickness of 0.03$\mu$)

Emulsion C was composed of silver iodobromide with silver bromide shells (having a thickness of 0.005$\mu$).

Emulsion D was composed of silver iodobromide without silver bromide shells.

Emulsion E was a non-laminated type composed of pure silver bromide.

The sensitometry of these samples was carried out in the following manner. The exposure was conducted by use of a light source having a colour temperature of 5400° K. and through an optical wedge for 1/50 second. The quantity of the exposure was 3.2 CMS. The development was conducted at 35° C. for 30 minutes in the following developer.

| Developer: | |
|---|---|
| Anhydrous sodium sulfite | 70 g |
| Hydroquinone | 10 g |
| Anhydrous boric acid | 1 g |
| Sodium carbonate monohydrate | 20 g |
| 1-Phenyl-3-pyrazolidone | 0.35 g |
| Sodium hydroxide | 5 g |
| 5-Methyl-benzotriazole | 0.05 g |
| Potassium bromide | 5 g |
| Glutaric aldehyde bisulfite | 15 g |
| Glacial acetic acid | 8 g |
| Water | To make up the developer of one liter. |

The results thereby obtained are shown in Table 1. The sensitivity was represented by a relative sensitivity based on the sensitivity of Sample 2 which was set to be 100. In the Table, S represents the sensitivity, Fog represents the fog density and CP represents the covering power.

TABLE 1

| Samples No. | Emulsions | S | Fog | CP | Distribution breadth* |
|---|---|---|---|---|---|
| 1 | A | 85 | 0.08 | 45 | 8 |
| 2 | B | 100 | 0.04 | 50 | 8 |

TABLE 1-continued

| Samples No. | Emulsions | S | Fog | CP | Distribution breadth* |
|---|---|---|---|---|---|
| | (Present invention) | | | | |
| 3 | C | 80 | 0.04 | 48 | 8 |
| 4 | D | 60 | 0.06 | 48 | 8 |
| 5 | E | 50 | 0.04 | 40 | 8 |

Note:

*Distribution breadth (%) = $\frac{\text{Standard deviation}}{\text{Average grain size}} \times 100$ As is apparent from the above results, Sample 2 according to the present invention has high covering power, superior sensitizing effectiveness and low fogging as compared with other Samples 1, 3, 4 and 5.

Further, the results shown in Table 1 indicate that there exists an optimal thickness of the shells.

EXAMPLE 2

The fixing speeds of Samples 1 and 4 of Example 1 were obtained by treating them in a non-exposed state with the fixing solution identified below and measuring the clearing time thereby obtained. (The clearing time is a period of time from the time when the film test piece was immersed in the fixing solution to the time when the emulsion layer was completely clarified to transparency).

| Fixing solution: | |
|---|---|
| Water (about 50° C.) | 600 ml |
| Sodium thiosulfate | 240 g |
| Anhydrous sodium sulfite | 15 g |
| Glacial acetic acid | 13.4 ml |
| Sulfuric acid | 7.5 g |
| Potash alum | 15 g |
| Water | To make up 1000 ml |

The results thereby obtained are shown in Table 2.

TABLE 2

| Samples | Clearing time (second) |
|---|---|
| 2 (Present invention) | 20 |
| 4 | 70 |

As is apparent from the above results, Sample 2 according to the present invention has a fixing speed considerably higher than that of Sample 3 according to the conventional method. This indicates that the emulsion of the present invention is suitable for speedy treatment.

EXAMPLE 3

In accordance with the conventional method disclosed in Japanese Patent Publication No. 1417/1976, an emulsion comprising core/shell grains composed of a core consisting of silver iodobromide containing 1.5 molar % of silver iodide and a shell consisting of silver bromide, was prepared. The average grain size was 1.2μ, and the distribution breadth was 35%. (This emulsion is designated as F).

In a manner similar to Example 1, this emulsion was aged, the additives were added thereto, and coating and drying operations followed, whereupon Sample 7 was prepared.

On the other hand, two kinds of emulsions G and H (each having a distribution breadth of 8%) according to the present invention, which have average grain sizes of 1.2μ and 0.6μ, respectively, and which comprise cores of silver iodobromide containing 1.5 molar % of silver iodide and shells of silver bromide having an average thickness of 0.03μ, were mixed in a ratio of 7:3 based on the weight of the silver halides to obtain Emulsion I having the same latitude as Sample 7.

In a manner similar to Example 1, the sensitivity and CP were measured. The results thereby obtained are shown in Table 3.

TABLE 3

| Samples | Emulsions | S | CP | Distribution breadth |
|---|---|---|---|---|
| 6 | B:G = 7:3 (weight ratio) (Present invention) | 100 | 45 | 8 in each of B and G |
| 7 | F (Conventional method) | 100 | 30 | 35 |

Note:
The sensitivity was represented by a relative sensitivity based on the sensitivity of Sample 6 which was set to be 100.

As is apparent from Table 3, the emulsion prepared by mixing the two types of silver halide grains of the present invention having different grain sizes so as to have the same latitude as the emulsion of the conventional method, has covering power considerably higher than that of the emulsion according to the conventional method.

We claim:

1. A light-sensitive silver halide emulsion which comprises silver halide grains composed of cores consisting essentially of silver halide containing silver iodide and shells covering said cores and consisting essentially of silver bromide, silver chloride or silver chlorobromide, each of said shells having a thickness of from 0.01 to 0.1μ.

2. A light-sensitive silver halide emulsion according to claim 1, wherein said cores are composed essentially of silver halide containing from 0.5 to 10 molar % of silver iodide.

3. A light-sensitive silver halide emulsion according to claim 1 or 2, wherein said shells consist essentially of silver bromide.

4. A light-sensitive silver halide emulsion according to claim 1, wherein said cores are composed of mono-dispersion type silver halide grains.

5. A light-sensitive silver halide emulsion according to claim 1 or 4, wherein each of said shells has a thickness of from 0.01 to 0.06μ.

6. A light-sensitive silver halide emulsion according to claim 1, wherein said cores consist essentially of mono-dispersion type silver halide grains containing from 0.5 to 10 molar % of silver iodide.

7. A light-sensitive silver halide emulsion according to claim 1 or 6, wherein said shells consist essentially of silver bromide, each of said shells having a thickness of from 0.01 to 0.06μ.

* * * * *